United States Patent [19]

Jones et al.

[11] Patent Number: 4,942,701

[45] Date of Patent: Jul. 24, 1990

[54] HYDRAULIC WINCH SYSTEM FOR USE IN ERECTING CLEAR-SPAN, POLE-TYPE BUILDINGS

[75] Inventors: Jimmie J. Jones, Portland, Oreg.; Sherman L. Watson, Vancouver, Wash.; Charles F. Pence, Portland, Oreg.

[73] Assignee: Complete Hydraulic Building Systems, Inc., Portland, Oreg.

[21] Appl. No.: 383,709

[22] Filed: Jul. 24, 1989

[51] Int. Cl.[5] ..... E04G 21/14

[52] U.S. Cl. ..... 52/126.1; 52/66; 52/126.5; 52/745; 52/749

[58] Field of Search ..... 52/126.1, 126.5, 66, 52/745, 749

[56] References Cited

U.S. PATENT DOCUMENTS

| | | | |
|---|---|---|---|
| 2,604,060 | 7/1952 | Hansen . | |
| 2,715,013 | 8/1955 | Slick | 254/106 |
| 2,836,054 | 11/1956 | Brauer . | |
| 3,396,944 | 8/1968 | Jansz | 254/89 |
| 3,449,872 | 6/1969 | Craighead | 52/66 |
| 3,921,362 | 11/1975 | Cortina | 52/745 |
| 3,968,618 | 7/1976 | Johnson | 52/745 |
| 4,251,974 | 2/1981 | Vanderklaauw | 52/745 |
| 4,679,374 | 7/1987 | Boehmig | 52/745 |
| 4,697,397 | 10/1987 | Okuda et al. | 52/223 |
| 4,831,792 | 5/1989 | Berger | 52/66 |

*Primary Examiner*—John E. Murtagh

*Attorney, Agent, or Firm*—Eugene D. Farley

[57] ABSTRACT

A hydraulic winch system for use in erecting clear span pole type buildings including two rows of spaced apart, vertically placed poles defining opposite sides of the building, and a plurality of roof supporting truss assemblies arranged side-by-side and each assembly supported by cooperating pairs of opposed poles. The system includes a hydraulic motor-driven winch; a portable base mounting the winch and transportable from pole to pole; pulleys mounted at the top of each pole; a cable mounted on the winch, reeved about the pulleys and extending downwardly with its end adjacent the truss assembly preliminary to hoisting the same to its erected position; and connecting means on the end of the cable for connection to the truss assembly. Using the winch system, the component truss assemblies of the building are hoisted one at a time from a low level building-assembly position to an elevated building-erected position where they are affixed to the tops of the poles, preparatory to mounting the roof thereon.

10 Claims, 3 Drawing Sheets

HYDRAULIC WINCH SYSTEM FOR USE IN ERECTING CLEAR-SPAN, POLE-TYPE BUILDINGS

This invention relates to an hydraulically operated winch system for use in erecting clear span, pole type buildings.

BACKGROUND AND GENERAL STATEMENT OF THE INVENTION

The architectural class of buildings commonly known as "pole buildings" are widely used where clear-span buildings are required for various purposes. Such purposes include riding academies, sports arenas, warehouses, agricultural buildings and the like.

Such structures are of relatively uncomplicated construction. They comprise simply two rows of spaced apart, vertically placed poles disposed in opposite pairs and defining opposite sides of the building. A plurality of roof-supporting truss assemblies of various designs are hoisted to the tops of the poles in side-by-side arrangement and suitably secured in their elevated position. A roof of the desired type and composition then is applied to the truss assemblies and siding of the desired type applied to the outsides of the posts to form the completed structure. This simple, economical, and widely used technique may be used successfully in the erection of buildings having clear spans of 100 feet, or even more.

However, the procedure is attended, by problems. As is evident, where truss assemblies having spans of the order of 100 ft are employed, the great weight of the truss assemblies makes their elevation from ground level to top-of-pole level difficult and hazardous both to equipment and personnel. The truss assemblies conventionally are araised by means of lift trucks, cranes, or hand operated winches attached to the tops of the poles. These procedures are inefficient, expensive, and often damaging to the trusses. They impose a severe limitation on the success of the operation, and in many cases, on the length of clear span which may be achieved by its practice.

It is the general purpose of the present invention to provide an hydraulic winch system which may be used rapidly and effectively in the erection of clear-span, pole-type buildings with safety, economy, and efficiency. By its application, it is possible to elevate each massive truss assembly and secure it in position at the top of the supporting poles in but a few minutes. It also is possible to achieve clear spans not heretofore readily achievable in the construction of buildings of this class.

The foregoing and other objects of the present invention are achieved by means of an hydraulic winch system which, in its broad aspect, comprises an hydraulic circuit including a plurality of rotary, hydraulic-motor-driven winches with suitable controls, and readily portable mounting and attaching means for mounting one of the winches adjacent to each pole. Adjustable cap pieces are removably mounted on the tops of the poles. Support type engaging means, preferably of the stirrup type, are provided at each end of the truss assembly.

Cables mounted on the winches at the bases of the poles are extended upwardly and reeved around the pulleys at the tops of the poles, with the free ends extending downwardly for attachment to the engaging means by which they are releasably engaged with the ends of the truss assemblies.

Depending upon the type and size of the truss assembly, there may be four such winching units employed in the elevation of one truss assembly. Two of the units are employed in conjunction with two poles on one side of the building, and two more employed in conjunction with two other poles at the opposite side of the building. By synchronous operation of the winches, the truss assembly may be elevated to the tops of the poles where it is secured by means of nailing, or otherwise. This sequence is employed successively with a plurality of the truss assemblies until the entire supporting structure of the roof has been completed.

THE DRAWINGS

DESCRIPTION OF A PREFERRED EMBODIMENT OF THE INVENTION

As indicated above, the clear-span, pole-type buildings, to the construction of which the herein described winch system is applied, are supported principally by two rows of spaced-apart, vertically-placed poles and a plurality of roof truss assemblies mounted on the poles in side-by-side relation to each other.

The poles 10 are disposed in opposite pairs and define opposite sides of the building. They are solidly mounted in the ground to a depth of several feet. If necessary, they may be embedded in concrete.

THE ROOF TRUSS ASSEMBLY

Although roof truss assemblies of various constructions and configurations are applicable for use in the present invention, the assembly illustrated (conventional) has a massive construction which is adaptable for use in the construction of clear span buildings of substantial width, for example a width of 100 feet or more. It was designed for mounting on two opposite pairs of poles 10. Since it is of great weight and extent, winching it upwardly from ground level to use level on posts 10, without damage to the truss assembly or injury to personnel, poses a particular problem.

Figure 1:
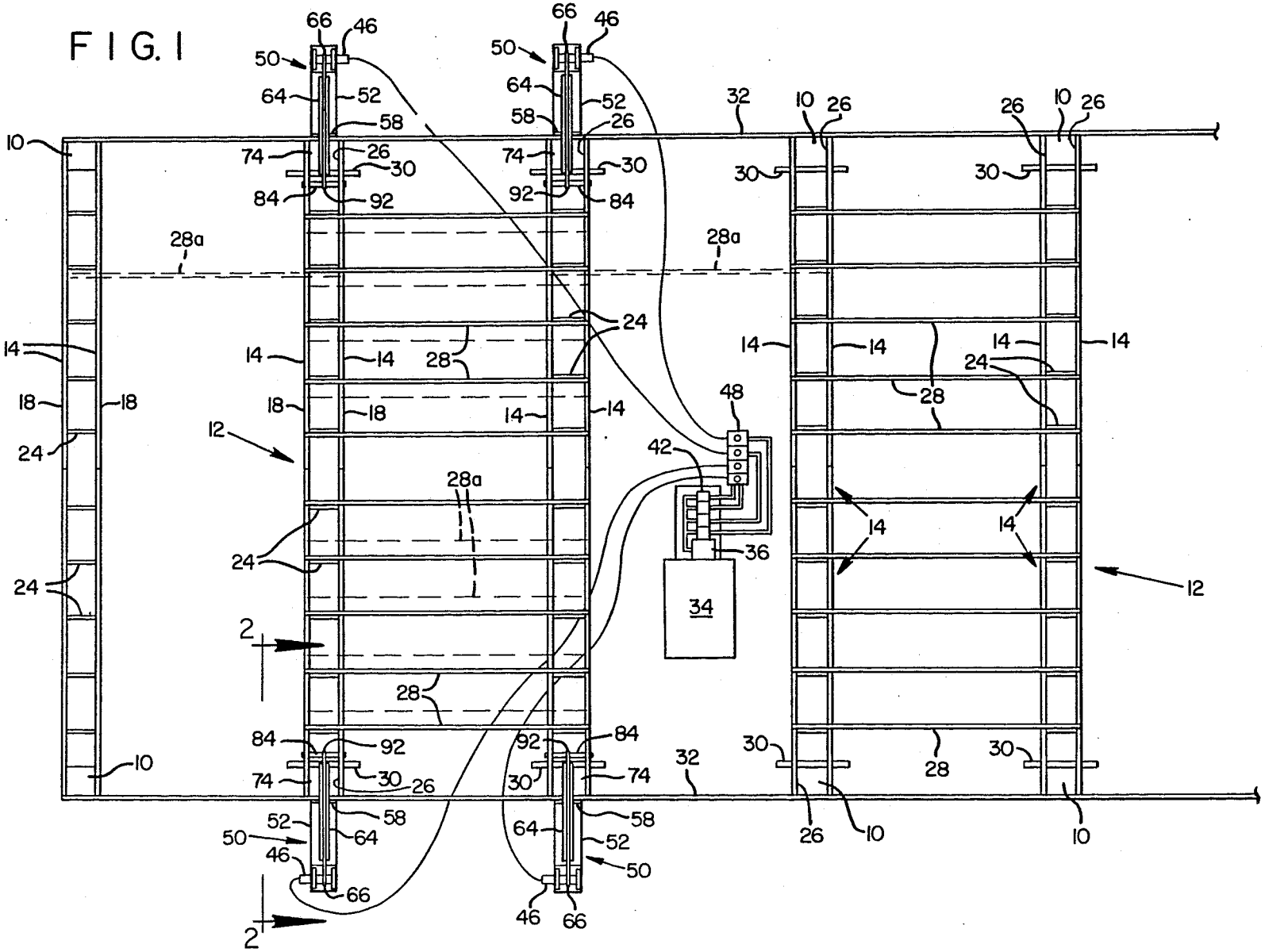
FIG. 1 is a fragmentary plan view, somewhat schematic, of a clear-span, pole-type building in the process of erection using the herein discribed hydraulic winch system.
Figure 2:
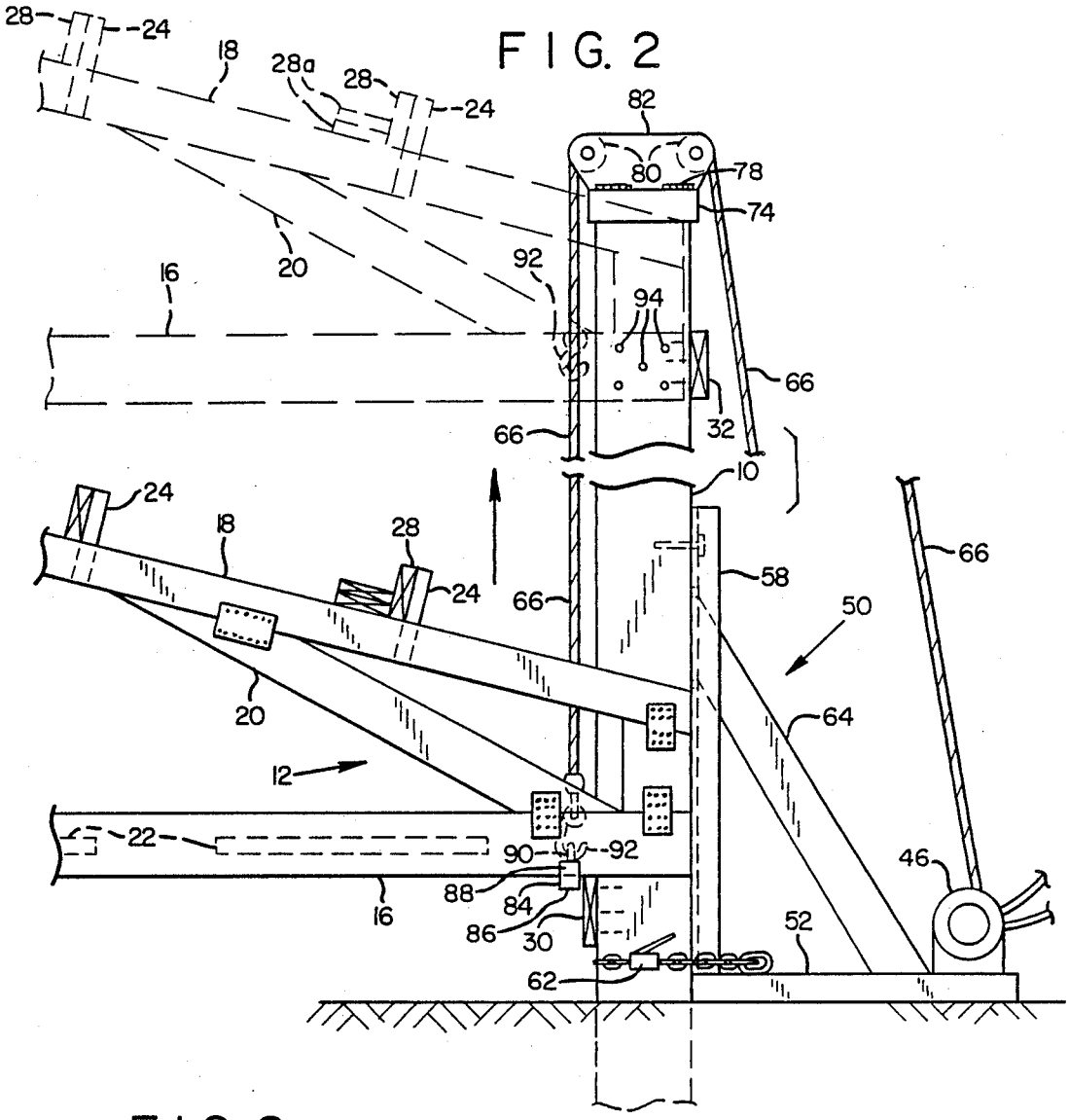
FIG. 2 is a foreshortened, detail view in elevation of a single winch component of the herein described hydraulic winch system, illustrated in its application to the elevation of a truss assembly from its ground level position at the base of the pole to its elevated position at the top of the pole.

The construction of the truss assembly, indicated generally at 12, is illustrated particularly in FIGS. 1 and 2.

Each truss assembly includes four individual trusses 14 arranged in pairs, one pair for each pair of posts 10, which the truss ends straddle, (FIG. 1).

Each truss 14 comprises, FIG. 2, a horizontally arranged lower chord 16, a ridged upper chord 18 and a plurality of appropriately disposed, angularly arranged struts or web members 20.

The paired struts are maintained in spaced-apart arrangement by means of longitudunally extending "strong back" boards 22, mounted between lower chords 16, and purlin blocks 24, mounted between ridged upper chords 18 and extending upwardly therefrom a predetermined distance.

The construction is such that the open ends of each pair of trusses straddle the adjacent pole 10 and form a yoke-shaped opening 26 dimensioned to receive the pole in sliding relationship.

They thus serve as guides for guiding the progress of the truss assembly as it is elevated on the pole.

The two pairs of trusses are interconnected by means of horizontal purlins 28 arranged in parallel relationship to each other and nailed to one face of purlin blocks 24.

It is noted that in the location of the truss assemblies a space, FIG. 1, is left between two adjacent assemblies. After elevation of the assemblies to their use position, this space is bridged by means of additional purlins 20*a* which are carried piggyback on one or both of the truss assemblies as they are raised to their elevated positions.

Truss support blocks 30 are nailed transversely to the insides of post 10. They support the truss assemblies during the time preliminary to hoisting them into position on the posts.

An eaves girt (girth) 32 is affixed to the outside of the poles for mounting of the eaves during construction of the building.

A single pair of trusses 14 is mounted on the terminal poles 10 at each end of the building. The above described truss assembly is conventional in its construction and is described in some detail herein for the purpose of illustrating a type of truss assembly which is difficult to hoist and to which the presently described winch system may be applied to advantage.

The winch system by means of which this is accomplished basically comprises a plurality of hydraulically driven winches and a control circuit therefor, winch mounting means adjacent the base of each pole for mounting the associated winch component, a winch cable, winch pulley means, winch pulley mounting means mounting the winch pulley means demountably at the top of each pole, and connecting means for connecting the winch cable to the truss assembly.

As noted above, each truss assembly includes structural members forming yokes or guideways receiving the associated poles in sliding engagement. Each assembly is shiftable during erection of the building between a low level, building-assembly position wherein it is fully slidable on the associated poles and an elevated, building-erected position wherein it is attached to the upper portions of the poles preparatory to mounting the roof thereon.

THE HYDRAULIC SYSTEM

Figure 8:
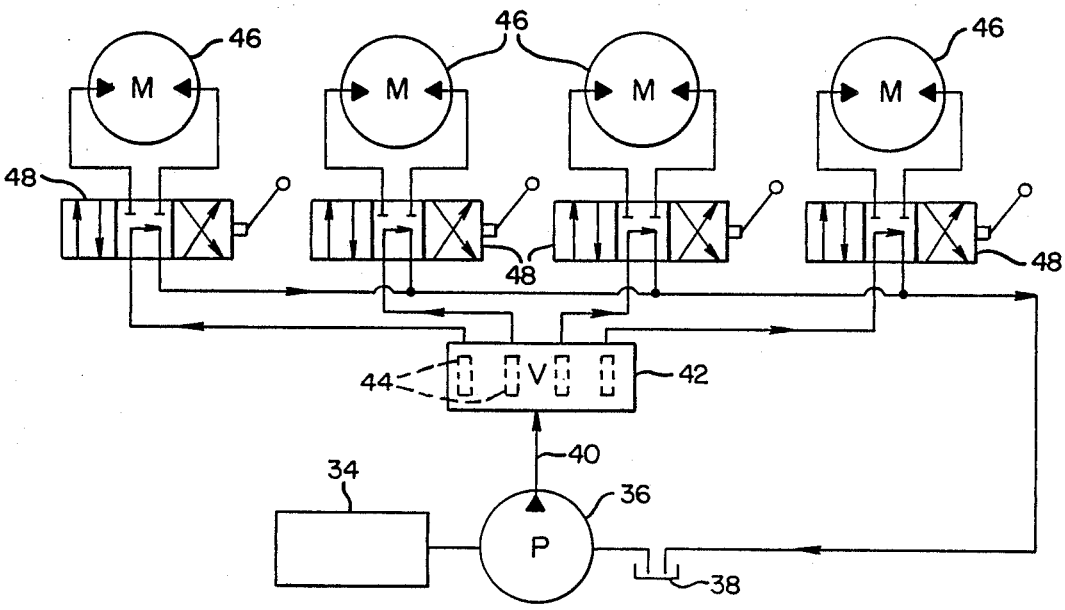
FIG. 8 is a schematic view of the hydraulic winching system employed.
Figure 3:
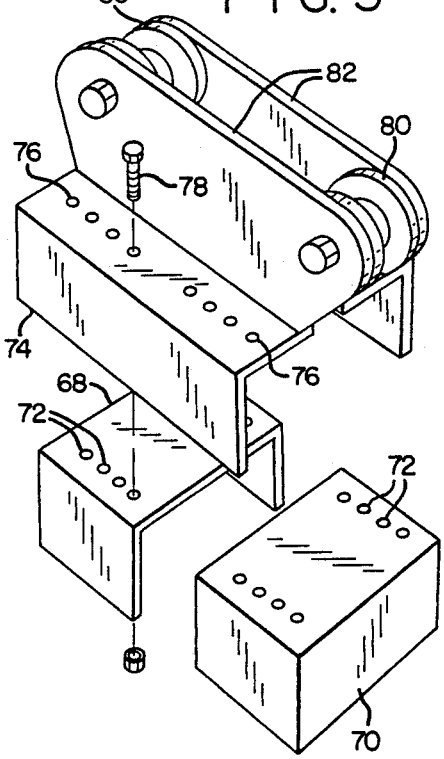
FIG. 3 is an exploded, detail view in top perspective of a pole cap piece and pulley component of the herein described system.

The hydraulic system is illustrated particularly in FIG. 8. It is designed to operate a plurality of hydraulic winches at a controlled and uniform rate, as required to elevate the substantial truss assembly described above at a controlled and uniform rate.

A gasoline engine 34 of suitable horsepower drives an hydraulic pump 36 which draws hydraulic fluid from a reservoir 38. The pump 36 pumps fluid to a manifold 4 which supplies a four section, gear pump type, flow divider 42. This unit includes a plurality (four in the present example) of gear type fluid pumps 44, which having for their function supplying four hydraulically powered winches 46, one for each pole 10. Included in the hydraulic circuit are three-position control valves 48, one for each winch. The valves function to control the flow of fluid to the winches, as required for idle, forward and reverse modes of operation.

THE WINCH MOUNTING UNITS

Figure 7:
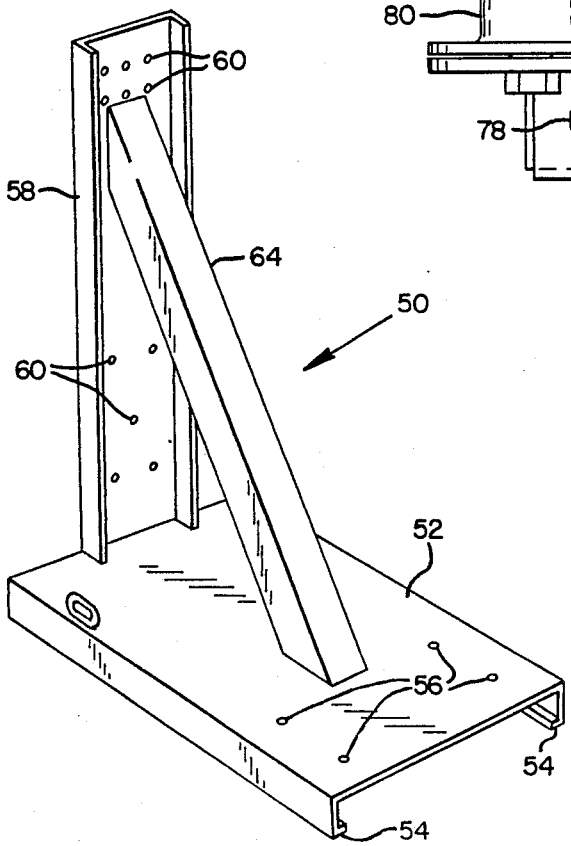
FIG. 7 is a top perspective view of winch mounting means employed for mounting each winch unit at the base of each participating pole.
Figure 6:
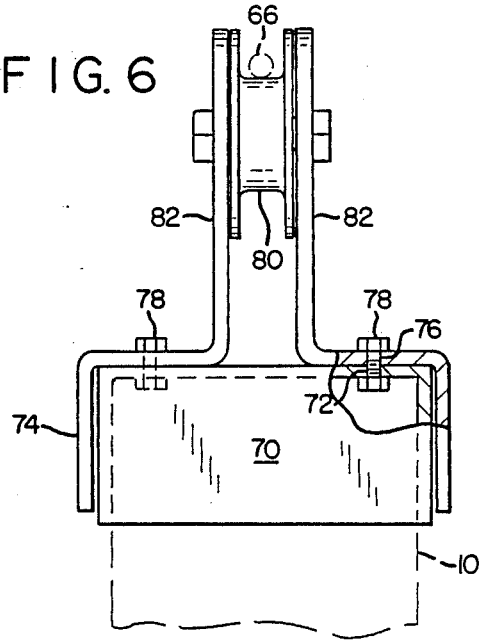
FIG. 6 is a view in end elevation thereof.

The winch mounting units, illustrated particularly in FIGS. 2 and 7, are designed to provide the advantages of portability between locations and stability during operation.

Each winch mounting unit is indicated generally at 50. It includes a base plate 52 which preferably is formed from a single sheet of structural metal bent in the manner indicated in FIG. 7 to form a pair of skids 54, one on each side. The plate is drilled at its outer end to form suitably located perforations 56 employed for mounting one of the hydraulic winches 46.

An upright or standard 58 is welded to the inner end of plate 52. It is adapted to be positioned against the outer surface of the associated pole 10 and is provided with means for temporarily securing it to the pole to ensure against upward slide of the winch and mounting plate during operation of the winch. In the illustrated form of the invention the securing means comprises a plurality of perforations 60 through which may be inserted nail or lag screws to fasten the plate temporarily to the pole.

A brace 64 extending between plate 52 and upright 58 further strengthens the mounting plate assembly.

THE CAP PIECE-PULLEY ASSEMBLY

The cap piece-pulley assembly has for its purpose providing means for guiding a cable 66 from winch 46 over the top of the pole, and downwardly to the end of truss assembly 12. It is comprised of two parts: a cap piece for the top of the pole and a mounting base for the pulleys or sheaths.

Poles 10 are available in various dimensions. They are most economically available when rectangular in cross section and in stock sizes of, for example, 6×6, 6×8, 6×10, and 6×12. The present invention provides a single cap piece which is adjustable to fit all of these sizes.

As illustrated in FIG. 3–6 inclusive, the cap piece comprises two parts 68 and 70 respectively. Each of these parts has a width sufficient to fit over the top of the pole The top of each has a plurality of perforations 72.

Figure 4:
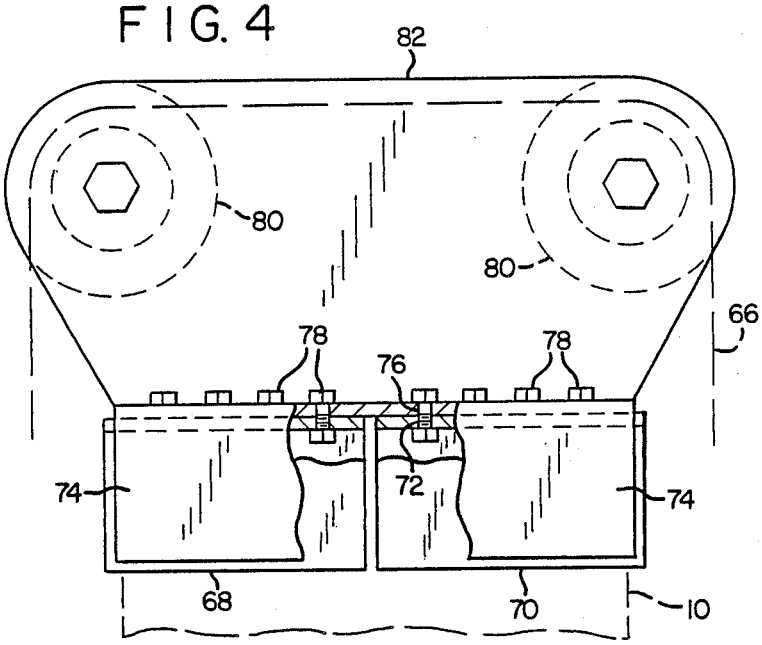
FIG. 4 is a view in elevation of the pole cap piece and pulley component, partly broken away better to show interior construction.
Figure 5:
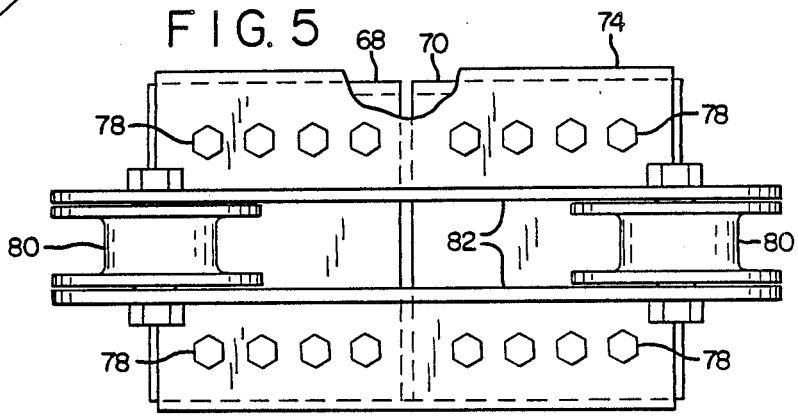
FIG. 5 is a plan view of the combination pole cap piece and pulley component.

The pulley base 74 comprises a member channel shaped in cross section dimensioned to fit over cap pieces 68, 70 in a nesting relation, with openings 76 in the base registering with holes 72 in the cap piece. Securing means such as bolts 78 are employed to releasably join the pole cap piece parts and the pulley mounting base in their operational position. In such position, the entire assembly rests gravitationally on the top of pole 10, as shown in FIG. 4.

Spaced pulleys 80 are rototably mounted between spaced, vertically-positioned support plates 82, completing the subassembly.

CABLE-TO-TRUSS CONNECTING ASSEMBLY

As noted above, the lifting cable 66 runs from winch 46, upwardly around pulleys 80, and downwardly to a plane below the plane of the truss assembly terminal portions to which lifting force is to be applied. The design of the connecting assembly is such as to bear against the undersurface of the truss assembly but without physical connection thereto and without inflicting any damage to the structural assembly despite the great weights involved.

As discussed hereinabove, the terminal portions of each pair of trusses 14 are spaced apart and open to provide a yoke or guide 26 which receives the bottom portion of pole 10 in guide-slide relationship.

The herein described connecting appliance works in the yoke space 26 between the truss ends. It comprises a stirrup block, indicated generally at 84, and comprising a base plate 86 with upturned opposite side edges 88. The stirrup block is dimensioned to seat beneath the ends of lower chords 16 of trusses 14 in the manner illustrated. A connector 90 provides means for attachment to the hook 92 on the end of cable 66. The assembly thus permits ready application to the undersurfaces of the chords preparatory to hoisting the truss assembly to its elevated use position on poles 10.

OPERATION

The manner of operation of our presently described hydraulic winch system for the erection of clear span, poletype buildings is as follows.

First, poles 10 are set in the ground in spaced, parallel rows in a secure manner as by being buried to a depth of several feet in gravel or even in concrete. The poles are centered and stabilized in position.

Eave girt positions are transit located and the eave girts 32 set in place.

The location of support blocks 30 at the bottoms of the poles is transit located and the support blocks set in place.

Truss assemblies 12 are assembled in the manner described above and illustrated in FIG. 1. Each assembly involves four trusses 14 arranged in pairs and connected by purlins 28. The arrangement is such as to cause the terminal portions of bottom chords 16 of each truss 14 to extend beyond the associated post 10 to form a guideway or yoke 26 partially surrounding each post 10.

Next pole cappieces 68, 70 are placed atop each associated pole in the proper position of adjustment. Pulley mount 74 is superimposed and the two parts interconnected releasably by means to bolts 78.

Winches 46 mounted on winch support plates 52 are located, one at the base of each pole. Spur type fasteners inserted through openings 60 in upright 58 temporarily secure the mount to the pole, preventing upward slide. This result is assisted by means of chain lock 62 releasably placed around both the base of upright 58 and the adjacent pole 10.

Next winch cable 66 is run from out each winch 44, reeved over pulleys 80, and extended downwardly to below the plane of lower chords 16 of the truss assemblies. Stirrup block 84 is attached to the free end of the cable.

Unsecured purlins **28*a* are placed on top of each truss assembly in the manner illustrated in FIG. 1**, for a piggyback ride upwardly as the truss assemblies are elevated.

Elevation of the truss assemblies is accomplished by manipulation of control valves 48 which enable raising the truss assembly, which may be several feet wide and over 100 ft long, uniformly up the height of the poles 10 until it reaches the level of eaves girt 32. There it is secured to the post by means of spikes or lag screws 94, FIG. 2.

Unsecured purlins **28*a* then are extended across the gap between the two truss assemblies and nailed to purlin blocks 24 in the manner indicated in dashed outline in FIG. 1**.

The roof, walls, and other parts of the building then are finished off in the usual manner.

Having thus described in detail a preferred embodiment of the present invention, it will be apparent to those skilled in the art that various physical changes may be made in the invention described without altering the inventive concepts and principles embodied. The present embodiment is therefore to be considered as illustrative and not restrictive, the scope of the invention being indicated by the appended claims.

We claim:

1. For use in erecting erecting clear-span, pole-type, buildings including two rows of spaced apart, vertically placed, support poles disposed in opposite pairs and defining opposite sides to the building, and a plurality of roof-supporting truss assemblies arranged side-by-side and each assembly supported by cooperating pairs of opposed poles, each assembly including structural members forming guideways receiving cooperating poles in sliding engagement, each assembly being shiftable during erection of the building between a low level, building-assembly position wherein it is freely slidable on said cooperating poles and an elevated, building-erected position wherein it is attached to the upper portions of the poles preparatory to mounting a roof thereon, an hydraulic winch system for raising the truss assembly from its building assembly position to its building erected position, the hydraulic winch system comprising:

(a) an hydraulic circuit, (b) in the hydraulic circuit a plurality of hydraulic winches, one for each associated pole, (c) in the hydraulic circuit valve means for controlling the speed and direction of rotation of each winch, (d) winch mounting means adjacent each associated pole, (e) pulley means mounted at the top of each associated pole, (f) cable means mounted on each winch, reeved about the associated pulley means, and extending downwardly with its end adjacent the truss assembly in its low level. building-assembly position, and (g) connecting means on the said end of the cable means for connection to the truss assembly.

2. The hydraulic winch system of claim 1 wherein the winch mounting means comprises a base plate adapted for location at the base of the pole, attaching means for attaching the winch to the plate, an upright extending upwardly from one end of the base plate, and securing means for securing the upright releasably to the pole.

3. The hydraulic winch system of claim 2 wherein the securing means for attaching the upright to the pole comprise spur-type securing means penetrating the upright and the pole.

4. The hydraulic winch system of claim 2 wherein the securing means securing the upright to the pole comprises chain lock means encircling the pole and upright.

5. The hydraulic winch system of claim 2 wherein the securing means for securing the upright of the pole comprise spur-type securing means penetrating the upright and the pole and chain lock securing means encircling the upright and the pole.

6. The hydraulic winch system of claim 2 including skid means on the underside of the base plate for skidding the mounting assembly from pole to pole.

7. The hydraulic winch system of claim 1 wherein the pulley means comprises a cap piece, cap piece mounting means for mounting the cap piece at the top of the pole, and pulleys mounted on the cap means for receiving the cable.

8. The hydraulic winch system of claim 7 wherein the cap piece comprises a pair of cap piece segments dimensioned to fit over opposite sides of the top of the pole, a pulley mounting segment dimensioned to fit over the cap piece segments in selected positions of adjustment relative thereto as determined by the cross section of the pole, releasable interengaging means for releasably interengaging the cap piece segments and the pulley mounting segment, and pulleys mounted on the pulley mounting segment and positioned for receiving the cable.

9. The hydraulic winch system of claim 1 wherein the truss assembly includes structural members forming guideways receiving cooperating poles in sliding engagement, and wherein the connecting means on the end of the cable means comprises stirrup means arranged to bear against the lower surfaces of said structural members.

10. The hydraulic winch system of claim 9 wherein the stirrup means comprise a horizontally arranged bar, vertically extending retainers on each end of the bar spaced to receive said structural members, and an eye centrally located on the upper surface of the bar for connection to the end of the cable.

* * * * *